US008231427B2

(12) United States Patent
Wong et al.

(10) Patent No.: US 8,231,427 B2
(45) Date of Patent: Jul. 31, 2012

(54) TRIM ADJUSTMENT FOR TOY VEHICLE STEERING

(75) Inventors: Chun Wing Wong, Kowloon (HK); Chung Ming Cheng, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/179,947

(22) Filed: Jul. 11, 2011

(65) Prior Publication Data

US 2011/0263180 A1 Oct. 27, 2011

Related U.S. Application Data

(62) Division of application No. 12/229,514, filed on Aug. 22, 2008, now Pat. No. 8,002,606.

(60) Provisional application No. 61/041,007, filed on Mar. 31, 2008.

(51) Int. Cl.
*A63H 17/36* (2006.01)

(52) U.S. Cl. ..... 446/468; 446/129; 446/469

(58) Field of Classification Search ..... 446/129, 446/454, 465, 468, 469
See application file for complete search history.

(56) References Cited

U.S. PATENT DOCUMENTS

| | | | |
|---|---|---|---|
| 796,893 | A | 8/1905 | Brennan |
| 2,182,385 | A | 12/1939 | Neracher et al. |
| 3,083,499 | A | 4/1963 | Balthazor |
| 3,474,564 | A | 10/1969 | Perryman |
| 3,574,969 | A | 4/1971 | Cleveland et al. |
| 3,614,686 | A | 10/1971 | Ellis |
| 3,705,387 | A | 12/1972 | Stern et al. |
| 4,034,504 | A | 7/1977 | Sudo |
| 4,135,328 | A | 1/1979 | Yamasaki |
| 4,163,341 | A | 8/1979 | Jones et al. |
| 4,296,852 | A | 10/1981 | Luerken |
| 4,411,100 | A | 10/1983 | Suimon |
| 4,471,566 | A | 9/1984 | Ishimoto |
| 4,571,213 | A | 2/1986 | Ishimoto |
| 4,743,214 | A | 5/1988 | Tai-Cheng |
| 4,767,376 | A | 8/1988 | Hanzawa et al. |
| 4,816,795 | A | 3/1989 | Suto |
| 4,881,917 | A | 11/1989 | Suzuki et al. |
| 4,896,899 | A | 1/1990 | Lawrence |
| 4,898,562 | A | 2/1990 | Ishimoto |
| 5,014,841 | A | 5/1991 | Gillespie |

(Continued)

FOREIGN PATENT DOCUMENTS

DE 3151952 7/1983

(Continued)

*Primary Examiner* — Gene Kim
*Assistant Examiner* — Joseph B Baldori
(74) *Attorney, Agent, or Firm* — Panitch Schwarze Belisario & Nadel LLP

(57) ABSTRACT

A toy vehicle includes a chassis, a right turning member that supports a right steerable road wheel and a left turning member that supports a left steerable road wheel. A rigid steering link extends across the chassis and has right and left ends that are operably connected to the right and left turning members. An actuator provides a pivoting motion on a horizontal axis extending longitudinally forward and rearward in the vehicle. The motion provided by the actuator moves the steering link side to side across the vehicle. The right and left road wheels are pivoted by the motion of the steering link. An adjustable trim mechanism includes a bias member that helps to maintain a neutral position of the steering link and a trim adjustment that modifies a position on the chassis at which the steering link and road wheels are maintained in the neutral position.

13 Claims, 7 Drawing Sheets

U.S. PATENT DOCUMENTS

| | | | |
|---|---|---|---|
| 5,158,495 | A | 10/1992 | Yonezawa |
| 5,261,853 | A | 11/1993 | Suto |
| 5,281,184 | A | 1/1994 | Suimon |
| 5,709,583 | A | 1/1998 | Suto et al. |
| 5,851,134 | A | 12/1998 | Chiu |
| 5,879,131 | A | 3/1999 | Arlton et al. |
| 6,095,081 | A | 8/2000 | Gochenour |
| 6,095,891 | A | 8/2000 | Hoeting et al. |
| 6,170,354 | B1 | 1/2001 | Lee et al. |
| 6,170,596 | B1 | 1/2001 | Triarsi et al. |
| 6,250,449 | B1 | 6/2001 | Haussner |
| 6,315,630 | B1 | 11/2001 | Yamasaki |
| 6,349,786 | B1 | 2/2002 | Gift |
| 6,350,173 | B1 | 2/2002 | Tsang |
| 6,482,069 | B1 | 11/2002 | Tilbor et al. |
| 6,616,501 | B2 | 9/2003 | Spalinski |
| 6,656,011 | B2 | 12/2003 | Yoneda |
| 6,692,333 | B2 | 2/2004 | Kislevitz et al. |
| 6,726,523 | B2 | 4/2004 | Baker et al. |
| 6,776,686 | B2 | 8/2004 | Todokoro |
| 6,827,627 | B2 | 12/2004 | Tsang |
| 6,971,942 | B2 | 12/2005 | Baker et al. |
| 6,997,774 | B2 | 2/2006 | Kaneko et al. |
| 7,094,125 | B2 | 8/2006 | Kaneko et al. |
| 7,666,055 | B2 | 2/2010 | Kim |
| 2001/0053653 | A1 | 12/2001 | Harada |
| 2002/0094752 | A1 | 7/2002 | Kaneko et al. |
| 2002/0123296 | A1 | 9/2002 | Tsang |
| 2003/0104758 | A1 | 6/2003 | Tilbor et al. |
| 2003/0201137 | A1 | 10/2003 | Crapo et al. |
| 2004/0162002 | A1 | 8/2004 | Yoneda |
| 2004/0198172 | A1 | 10/2004 | Kaneko et al. |
| 2005/0250413 | A1 | 11/2005 | Lo et al. |
| 2006/0217034 | A1 | 9/2006 | Kim |
| 2009/0325460 | A1 | 12/2009 | Leonov |

FOREIGN PATENT DOCUMENTS

| | | |
|---|---|---|
| EP | 307658 | 3/1989 |
| GB | 2201549 | 9/1988 |
| GB | 2386082 | 9/2003 |
| JP | 2005192621 | 7/2005 |

TRIM ADJUSTMENT FOR TOY VEHICLE STEERING

CROSS-REFERENCE TO RELATED APPLICATIONS

The present application is a division of U.S. patent application Ser. No. 12/229,514 filed Aug. 22, 2008, and claims the benefit of U.S. Provisional Patent Application No. 61/041,007, filed on Mar. 31, 2008 and entitled "Steering Arrangement for a Toy Vehicle", which is herein incorporated by reference.

BACKGROUND OF THE INVENTION

The present invention relates to toy vehicles and, more particularly, to a trim adjustment for toy vehicle steering that is used to maintain a generally neutral or central position of the steering wheels of a vehicle when a user is not turning the vehicle.

Various conventional toy vehicles employ a steering arrangement that includes a single, rigid steering link or "tie rod" connecting together a pair of individually pivotally mounted, steerable front wheels. The front wheels are turned left or right by reversible operation of a power-converting device like a steering motor or solenoid for converting the direction of the front wheels between a straight or neutral direction and a right turn direction or a left turn direction. However, these direction-converting devices are difficult to maintain in a central or "straight" orientation when the user is not attempting to steer the toy vehicle. Moreover, parts of the steering arrangement are relatively easily damaged from aggressive play or accident and can be thrown out of alignment such that the toy vehicle moves in a turning direction when it should be moving in a straight line.

Therefore, it would be desirable to create an adjustable trim mechanism of a steering mechanism of a toy vehicle that overcomes the above-described disadvantage. Specifically, it would be desirable to create a trim adjustment of a trim mechanism of a steering arrangement for a toy vehicle that helps stabilize the steering arrangement of the vehicle to maintain a generally neutral or central position of the steering wheels of the vehicle when a user is not turning the vehicle and to adjust the steering arrangement when necessary to maintain the neutral or central position.

BRIEF SUMMARY OF THE INVENTION

Briefly stated, the present invention is a trim adjustment for toy vehicle steering. The toy vehicles includes a chassis having opposing right and left sides and opposing front and rear end. A right steerable road wheel is located on the right side of the chassis and a left steerable road wheel is located on the left side of the chassis. A right turning member supports the right road wheel and a left turning member supports the left road wheel. Each of the right and left turning members are pivotally mounted to the chassis to pivotally support a separate one of the steerable road wheels from the chassis. A rigid steering link extends across the chassis in a width direction and has a right end, a left end and a central portion therebetween. The right and left ends of the steering link are operably connected to the right and left turning members, respectively. An actuator mounted onto the chassis moves the steering link linearly side to side on the vehicle. The right and left road wheels are pivoted by the motion of the steering link. An adjustable trim mechanism mounted to the chassis includes a trim adjustment member is repositionably mounted on the chassis so as to be accessible for manual access on an underside of said chassis, and modifies a position on the chassis at which the steering link and road wheels are maintained in the neutral position. It also has two spaced-apart beams extending between said trim adjustment member and said steering link generally orthogonally with respect to said steering link, a first end of said two beams extending into contact with part of said steering link and a second end of said beams coupled with said trim adjustment member so as to be pivoted by said trim adjustment member around a pin extending vertically from said chassis.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings three embodiments which are presently preferred. It should be understood, however, that the invention is not limited to the precise arrangements and instrumentalities shown.

In the drawings.

DETAILED DESCRIPTION OF THE INVENTION

Figure 1:
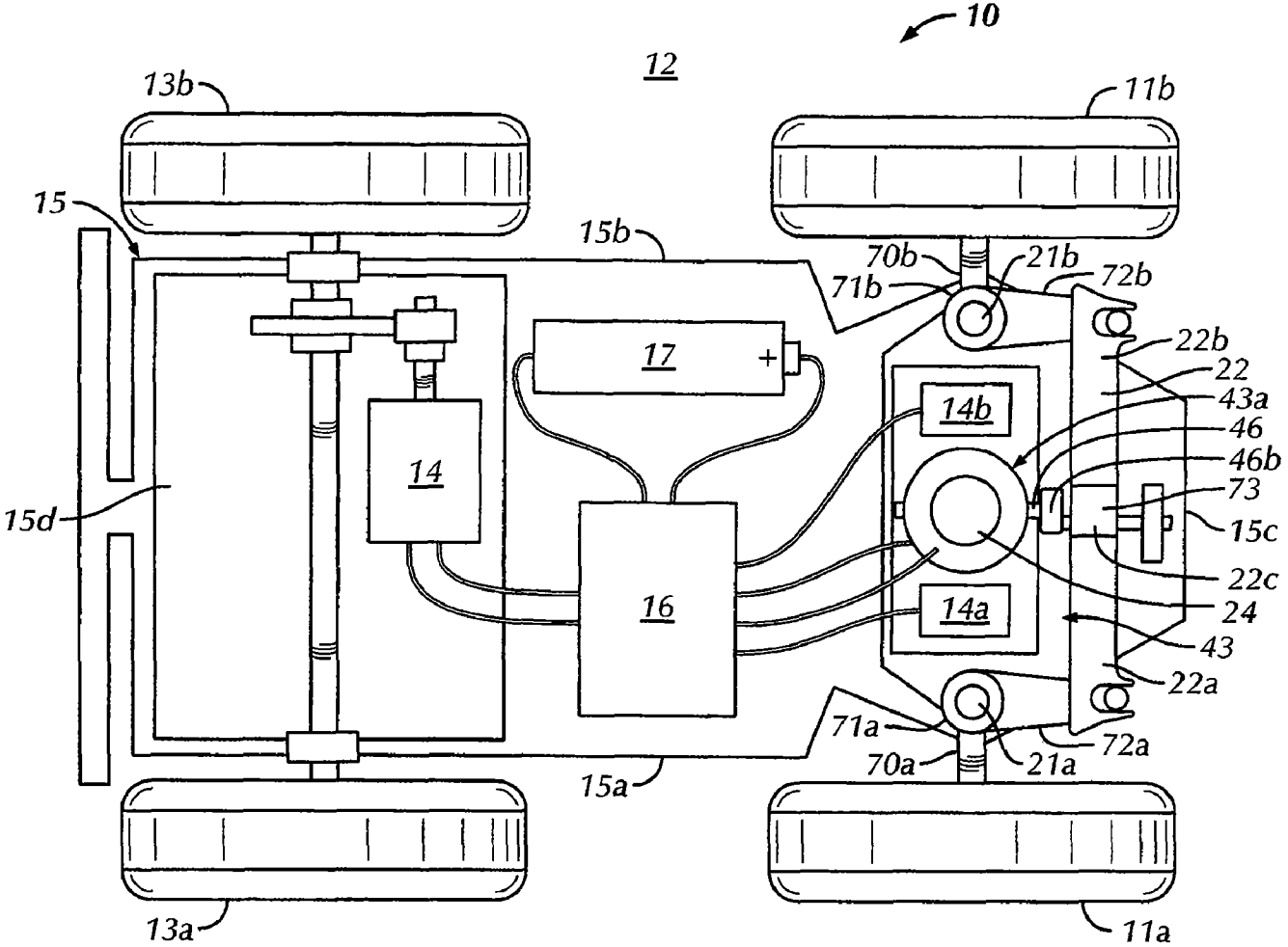
FIG. 1 is a top perspective view of generic toy vehicle of the present invention, with a body cover of the vehicle removed for clarity and the steerable wheels and steering mechanism in a neutral, straight-ahead steering configuration.

Certain terminology is used in the following description for convenience only and is not limiting. Unless otherwise indicated, the words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIG. 1 a toy vehicle 12 with a steering arrangement 10 that is generic to the various embodiments of the present invention. Generally, the toy vehicle 12 includes a chassis 15 with opposing right and left sides 15*a*, 15*b*, and opposing front and rear ends 15*c*, 15*d*, which reference numbers are also used to identify right and left sides and front and rear ends of the vehicle 12. A plurality of road wheels are coupled with the chassis 15 so as to support the vehicle 12 for itinerant movement across a surface, at least one of the road wheels being supported from the chassis 15 to pivot about an at least generally vertical axis so as to steer the vehicle 12. Preferably, the toy vehicle 12 has right and left, preferably identical, steerable road wheels 11*a*, 11*b*, respectively, pivotally supported from the chassis 15 proximal one of the ends 15*c*, 15*d* of the toy vehicle 12 and chassis 15, a front end 15*c* in the depicted vehicle 12, so as to pivot about at least generally vertical axes.

Further, the toy vehicle 12 includes means to propel the vehicle 12 on the steerable road wheels 11*a*, 11*b*. Toy vehicle 12 may include at least one drive wheel suggestedly located proximal a remaining end of the toy vehicle 12 and chassis 15 to propel the toy vehicle 12. The depicted toy vehicle 12 preferably includes two identical, spaced apart, coaxially aligned drive wheels 13*a*, 13*b*, on opposite sides 15*a*, 15*b* of the vehicle 12 and chassis 15 proximal the rear end 15*d*, again as is typically found in the prior art. As is conventional, the toy vehicle 12 may also be provided with an electric propulsion motor 14 drivingly coupled with the drive wheels 13*a*, 13*b* and electronic control circuitry, indicated diagrammatically at 16, for selectively connecting an electric power source 17 such as a battery pack or capacitor on the chassis 15 or rails under the chassis 15 running over electrified tracks (also not depicted) to the propulsion motor 14 and/or the steering arrangement 10.

Figure 2:
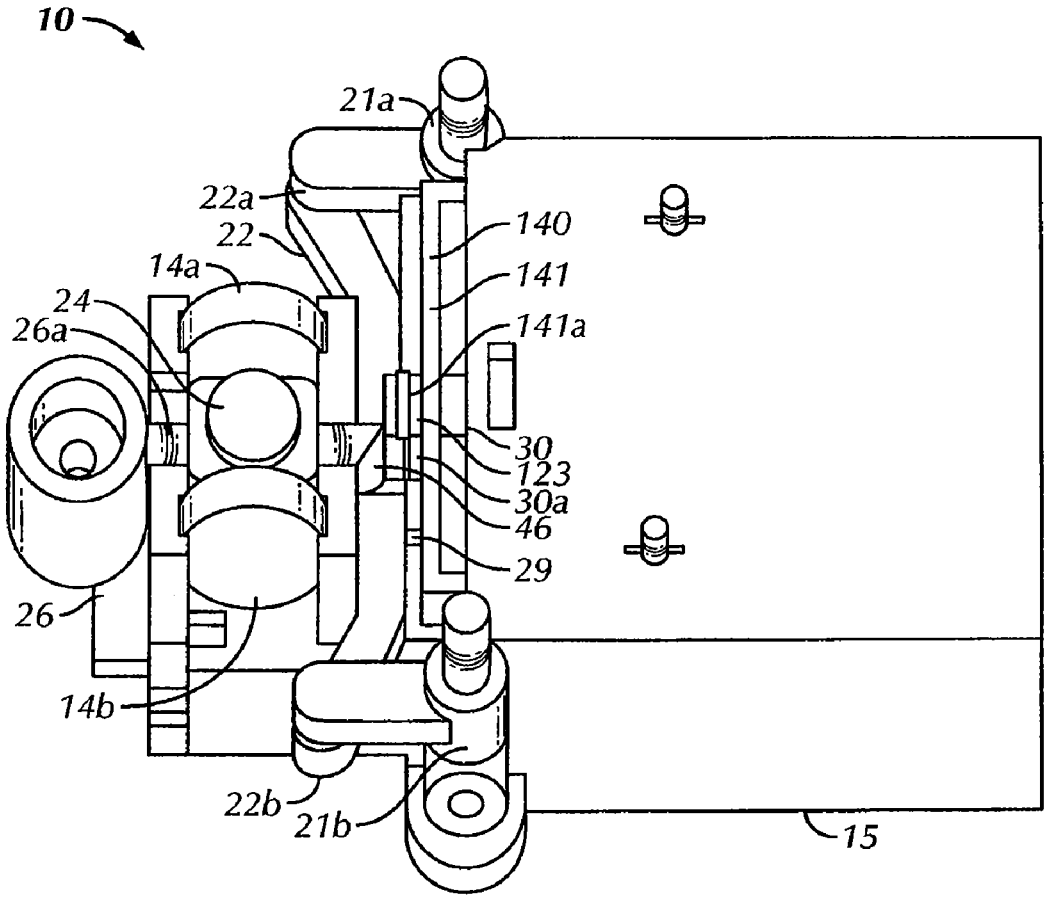
FIG. 2 is a perspective view of the top and left side of an adjustable trim mechanism of a steering arrangement of a toy vehicle in accordance with a first preferred embodiment of the present invention, with the steering arrangement in a neutral or straight-ahead steering configuration, and with a body cover of the vehicle, front cover of a chassis and right and left road wheels removed for clarity.
Figure 3:
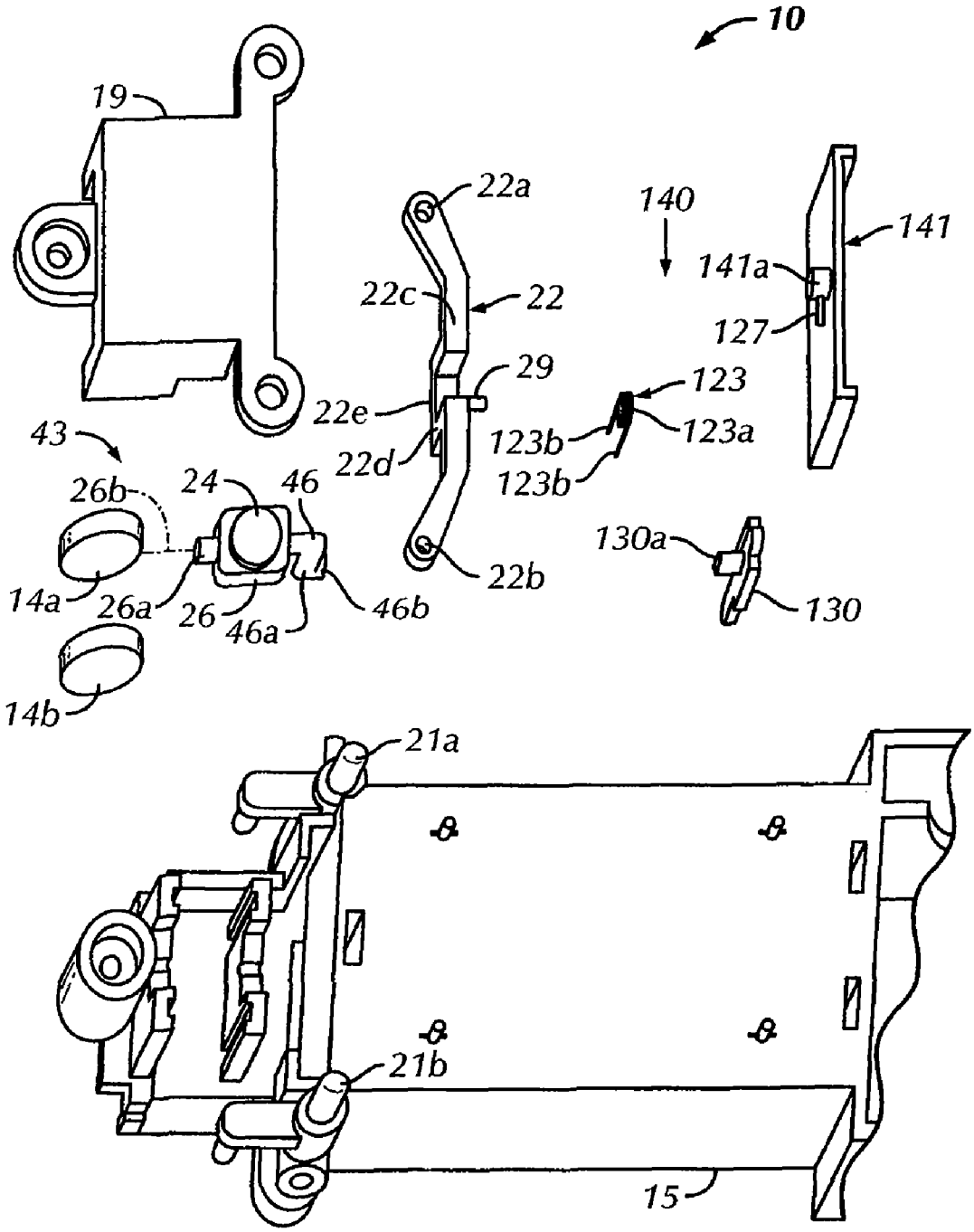
FIG. 3 is an exploded perspective view of the left side of the steering arrangement shown in FIG. 2, with the right and left road wheels removed for clarity.

As seen in FIGS. 1-3, the steering arrangement 10 preferably includes a right turning member 21*a* and a left turning member 21*b* that are pivotally mounted to the chassis 15 of the toy vehicle 12. The right and left turning members 21*a*, 21*b* are pivotally supported by the chassis 15 so as to be turnable such that the toy vehicle 12 may be driven in a clockwise (not shown) or counterclockwise (not shown) direction. Each of the right and left turning members 21*a*, 21*b* includes a stub axle 70*a*, 70*b*, respectively, extending outwardly from a main or central body 71*a*, 71*b*, respectively, to rotatably support the right and left steerable road wheels 11*a*, 11*b*, respectively, for rotation about their respective central axes during movement of the toy vehicle 12 on a road or other support surface. The right and left turning members 21*a*, 21*b*, are themselves pivotally mounted on the chassis 15 so as to steerably support the right and left road wheels 11*a*, 11*b* on the chassis 15. Each turning member 21*a*, 21*b* further includes a steering arm 72*a*, 72*b*, respectively, projecting outwardly from another side of the central body 71*a*, 71*b* spaced away from the stub axles 70*a*, 70*b*, respectively.

The steering arrangement 10 includes a steering link 22 preferably extending in at least a generally horizontal, width direction across the chassis 15 between the right and left turning members 21*a*, 21*b*. More particularly, right and left ends 22*a*, 22*b*, respectively, of the steering link 22 are operably pivotally connected with the right and left turning members 21*a*, 21*b* through the distal ends of each of the steering arms 72*a*, 72*b*, respectively. Steering link 22 operably connects together the right and left turning members 21*a*, 21*b* for simultaneous steering movement of the right and left steerable road wheels 11*a*, 11*b*, respectively. The steering link 22 further includes a central portion 22*c* between the ends 22*a*, 22*b* preferably configured for side to side gliding movement across the chassis 15, for example. The central portion 22*c* further includes a centrally located arch 22*d* with an at least generally vertically extending opening 73 which is operably coupled with an actuator subassembly 43 of the steering arrangement 10 that is mounted to the chassis 15.

Actuator subassembly (or simply "actuator") 43 preferably includes a rotary-action solenoid (hereinafter simply "solenoid") indicated generally at 43*a* with an armature in the form of a magnetic body 24 mounted in a magnet housing 26 so as to pivot on a pivot axis 26*b* (FIG. 3) extending longitudinally front and rear along the chassis 15 in the vehicle 12. The magnetic body 24 includes a central axis at least generally perpendicular to the pivot axis. The two opposite magnetic poles N, S are generally centered along the central axis at the opposing distal ends of the magnetic body 24 on opposite sides of the pivot axis. While a single permanent magnet is preferred for providing the magnetic body 24, the magnetic body 24 may alternatively be provided by several stacked individual permanent magnets (not depicted). However, the actuator 43 may be in the form of a conventional steering motor (not shown). The magnet housing 26 has a front stub shaft 26*a* that is pivotally received in an approximately shaped groove in the chassis 15. The front stub shaft 26*a* helps to maintain the generally central location of the magnet housing 26 with respect to the chassis 15 when the magnet housing 26 is pivoting with respect to the chassis 15. Those skilled in the art understand that the present embodiment is not limited to the combination of the magnet housing 26 and the magnetic body 24. For example, the magnetic body 24 may be directly supported by the chassis 15, assuming the magnetic body 24 could pivot on an axis extending longitudinally forward and rearward in the toy vehicle 12.

Actuator 43 operably connects the solenoid 43*a* with the steering link 22 to convert rotational movement of the solenoid 43*a* into at least generally linear motion of the steering link 22. Preferably, this includes a crank 46 on the pivot axis 26*b* proximal to the steering link 22. A distal end portion 46*b* of the crank 46 is parallel to but displaced from the pivot axis 26*b* and is movably received in the opening 73 in the steering link 22 and converts rotational motion of the magnetic body 24 and magnet housing 26 into sideways gliding movement of the steering link 22. In this way, the crank 46 is connected by a crank arm 46*a* with the magnetic body 24 to pivot with the magnetic body 24 and with the steering link 22 to simultaneously move the steering link 22 side to side on the chassis 15 and toy vehicle 12. In operation, an electric current is passed in a selected direction through a coil 14, comprised of two halves 14*a*, 14*b*, of the actuator 43 and the magnetic body 24 is pivoted about the pivot axis 26*b* and thereby pivots the right and left steerable road wheels 11*a*, 11*b* from the neutral, straight ahead steering configuration shown in FIG. 1 into right turn and left turn steering configurations (not shown), respectively.

Referring to FIGS. 2 and 3, a first preferred embodiment of an adjustable trim mechanism of a steering arrangement 10 for steering a toy vehicle 12 is generally designated 140. The trim mechanism 140 allows a user to stabilize the steering arrangement 10 of the vehicle 12 to maintain a generally neutral or central position of the steerable wheels 11*a*, 11*b* of the vehicle 12 when the user is not turning the vehicle 12 and to adjust the steering arrangement 10, when necessary, to maintain a desired neutral or central position. The adjustable trim mechanism 140 includes a plate 141 that is positioned or mounted vertically onto the chassis 15, for example, by fitting the plate 141 within a vertically-extending slot of the chassis 15. A tab 141*a* extends generally orthogonally from a face of the plate 141 and a bias member 123, preferably in the form of a torsion coil spring, vertically extends from the tab 141*a* of the plate 141. Specifically, a spiral portion 123*a* of the spring 123 (FIG. 3) engages the tab 141*a*. Two rod portions 123*b* extend from opposite sides of the spiral portion 123*a* of the spring 123 and are hung so as to sandwich or partially surround a lug-like portion or projection 29 of the central portion 22*c* of the steering link 22. The coil spring 123 keeps the steering link 22 in a generally neutral position, which is not biased in either a right turn (i.e. clockwise when viewing the vehicle 12 from above) or left turn (i.e. counterclockwise when viewing the vehicle 12 from above) direction.

In the first preferred embodiment, the adjustable trim mechanism 140 is located rearward on the chassis 15 with respect to the steering link 22. However, it is understood by those skilled in the art that the location, shape, size and construction of the trim mechanism 140 is not limited to above-described configuration. For example, the trim mechanism 140 may be located in front of the steering link 22 on the chassis 15, such that the projection 29 would extend from or engage a front side of the steering link 22. Further, it is understood by those skilled in the art that the spring 123 is not limited to being mounted onto the 141 in a vertical configuration, but may be mounted at virtually any angle in which the spring 123 can maintain the steering link 22 in the neutral position or central position.

The adjustable trim mechanism 140 preferably includes a trim adjustment member 130 in the form of a lever that allows the user set the steering link 22 and road wheels 11*a*, 11*b* in the "neutral" position. The trim adjustment member 130 is repositionably mounted to the plate 141. Preferably, the trim adjustment member 130 is pivotally mounted to a "rear" side of the plate 141 in a vertical orientation. A lug-like portion or extension 130*a* on a "front" side or surface of the trim adjustment member 130 preferably extends through an opening 127 generally centrally located in the plate 141. When the trim adjustment member 130 and bias member 123 are mounted to opposing sides of the plate 141, the two rod portions 123*b* of the spring 123 are hung so as to further sandwich or partially surround the extension 130*a*. The rear side of the plate 141 may include a plurality of spaced-apart releasable engagement members, for example teeth or ridges (not shown), to releasably engage one or more members like other teeth or ridges (not shown) on the front side of the trim adjustment member 130. The releasable engagement members help to maintain the trim adjustment member 130 in the desired angular position. When mounted to the plate 141, a lower end of the trim adjustment member 130 extends through a lower wall of the chassis 15 such that a user can manually change the angular position of the trim adjustment member 130 on plate 141 from beneath the toy vehicle 12. It is understood by those skilled in the art that the trim adjustment member 130 is not limited to the size, shape and location described above, but may be modified in virtually any manner without departing from the spirit and scope of the present invention. Further, those skilled in the art understand that the trim mechanism 140 is not limited to the inclusion of the trim adjustment member 130.

The shape of the steering link 22 and structure of the actuator 43 used in conjunction with the adjustable trim mechanism 140 of the first preferred embodiment are slightly different than that shown and described above for FIG. 1. However, the operation and steering of the toy vehicle 12 is substantially similar to that shown and described above for FIG. 1.

Specifically, when viewed from the front or rear, the steering link 22 of FIGS. 2 and 3 preferably has a generally "V" or "U" shape structure 22*e* (FIG. 3) within the central portion 22*c* such that the structure 22*e* extends below both the right and left ends 22*a*, 22*b* when viewed from the front or rear sides. Projection 29 (FIG. 3) helps maintain the steering link 22 in a "neutral" or central position on the chassis 15 when the toy vehicle 12 is not being steered. It is understood by those skilled in the art that the projection 29 may be integrally formed with the central portion 22*c* or as part of the structure 22*e*.

The steering arrangement 10 includes at least one coil fixedly attached to the chassis 15 generally proximate the magnetic body 24 and magnet housing 26. Preferably, the steering arrangement 10 of the present embodiment includes one coil 14 broken into first coil half 14*a* and a second coil half 14*b* that are fixedly mounted onto the chassis 15 in a spaced-apart configuration on opposite sides of the central axis 26*b*. In the present embodiment, the coil halves 14*a*, 14*b* are located in front of the steering link 22 and trim mechanism 140 and are each located on a lateral side of the magnetic body 24. However, it is understood by those skilled in the art that the coil halves 14*a*, 14*b* may be located behind the steering link 22 and trim mechanism 140. Alternatively, one coil half 14*a* may be located anywhere around the magnetic body 24, while the other coil half 14*b* is diametrically opposed with respect to the magnetic body 24 on opposite sides of axis 26*b*.

As is understood by those skilled in the art, the coil halves 14*a*, 14*b* are electrically connected to one another and the electronic control circuitry 16 such that an electric current may be passed simultaneously in the same direction through both of the coil halves 14*a*, 14*b*. The coil halves 14*a*, 14*b* shown in the drawings may each include a core. However, the coil halves 14*a*, 14*b* may be in the form of coreless (i.e., air core) coils. The purpose of using an air core coil is that the size of the toy vehicle 12 may be decreased and lightened by elimination the core. However, when using a coreless (air core) coil, a magnetic force generated by the coil is weaker than when using a coil having a core. Furthermore, while one coil split into two halves is preferred, it will be appreciated that 14*a* and 14*b* can be separately controlled coils. Additionally, a front cover 19 may be removably mountable to the chassis 15 proximate a front end of the chassis 15 to enclose and protect the steering arrangement 10.

In operation, the user sends a control signal to the toy vehicle 12, typically from a manually operated remote controller (not depicted), to turn the toy vehicle 12 in either the right (clockwise) or left (counterclockwise) direction. Upon this indication, the electronic control circuitry 16 passes an appropriate current through the at least one coil 14. As the coil 14 is charged, an attractive force is generated between the at least one coil 14 and one end of the magnetic body 24 and a repulsive force is generated between the coil 14 and the opposite end of the magnetic body 24. In the embodiment that includes both a first and second coil halves 14*a*, 14*b*, an attractive force is generated between one of the coil halves 14*a*, 14*b* and a first end and the magnetic body 24 while a repulsive force is generated between the other coil halves 14*a*, 14*b* and that same end of the magnetic body 24 to apply complimentary torsional forces from opposing sides of the magnetic body 24. As the magnetic body 24 pivots, the crank 46 and the distal end portion 46*b* of crank 46 are pivoted, pushing the steering link 22 across the chassis 15 in a width direction.

As the steering link 22 is moved across the chassis 15, the turning members 21*a*, 21*b* are pivoted on the chassis 15 in the same lateral direction and, in turn, change the direction of the right and left steerable road wheels 11*a*, 11*b* in either the clockwise (right turn) or counterclockwise (left turn) direction. When the current flow has ceased from the electronic control circuitry 16 through the coil 14 (typically initiated by the user releasing a steering actuator on the remote controller), there is no longer attractive/repulsive forces between the coil halves 14*a*, 14*b* and the permanent magnet 24. Since there is no longer attractive/repulsive forces, the inherent tension in the rod portions of the spring 123 pushes the steering link 22 back towards the "neutral position" established by the positioning of the trim adjustment member 130, since the spring 123 surrounds the projection 29 of the central portion 22*c* of the steering link 22. Thus, the turning members 21*a*, 21*b* and the right and left steerable wheels 11*a*, 11*b* are repositioned in the generally straight or neutral direction.

Figure 4:
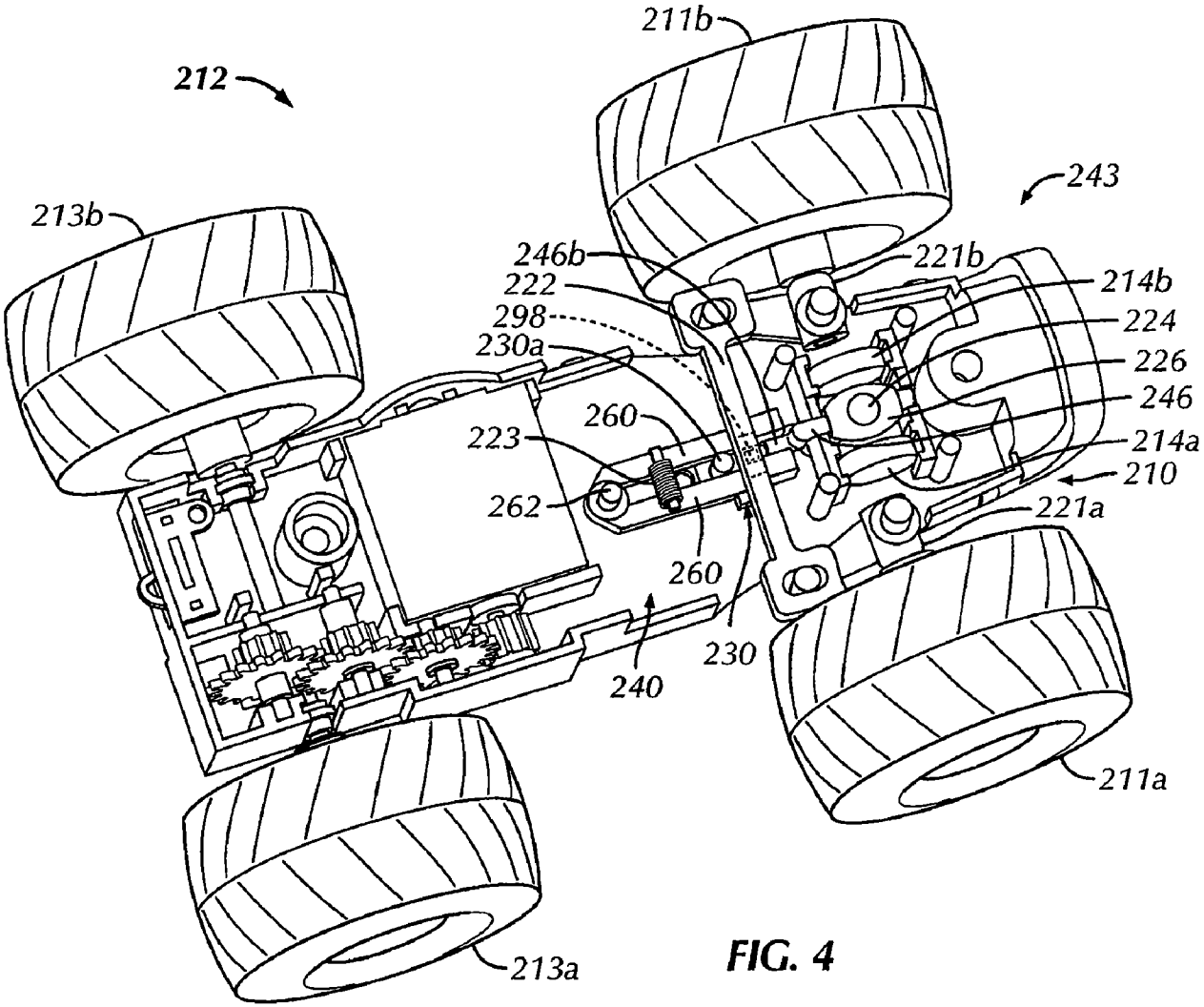
FIG. 4 is a perspective view of essentially the top of an adjustable trim mechanism of a steering arrangement of a toy vehicle in accordance with a second preferred embodiment of the present invention, with a body cover of the vehicle and a front cover of a chassis of the vehicle removed for clarity.

Referring to FIG. 4, a second preferred embodiment of an adjustable trim mechanism 240 of a steering arrangement 210 for steering a toy vehicle 212 is shown, including like reference numerals to like indicate like elements. It is understood by those skilled in the art that the toy vehicle 212 and steering arrangement 210 are not limited to the inclusion of the elements shown, but may include additional or fewer elements without departing from the spirit and scope of the present invention. For example, the turning members 221*a*, 221*b* and the steering link 222 may be formed as one, unitary structure, for example with integral, flex fold hinges at the distal ends of the unitary member, and the coil halves 214*a*, 214*b* of the actuator 243 may be replaced by a single undivided coil (not shown).

A primary difference between the second and first embodiments is that the adjustable trim mechanism 240 of the second preferred embodiment is horizontally arranged and includes a first end located proximate the steering link 222 and a second end located proximate a mid-section of the toy vehicle 212. Specifically, the adjustable trim mechanism 240 is generally in the form of two spaced-apart beams 260 mounted to a pivot or pin 262 so as to orthogonally extend from the pivot 262 to a rear face of the steering link 222. The trim mechanism 240 generally extends parallel to the length of the chassis 215 of the toy vehicle 212. The free ends of beams 260 are located on either side of a lug portion 298 (in phantom) on a hidden side of steering link 222. A bias member 223, preferably in the form of a tension coil spring, is located between the first and second ends of the beams 260 of the trim mechanism 240, orthogonally extending between the beams 260. Spring 223 keeps the beams 260 clamped against a lug-like portion or projection 230*a* of a trim adjustment member 230, which is supported on the chassis 215 for side-to-side adjustment or adjustable positioning on the chassis 215. The coil spring 223, in combination with the beams 260, helps to keep the steering link 222 in a generally "neutral" position (FIG. 4), which is not biased in either right turn (i.e. clockwise when viewed from above the toy vehicle 212) or left turn (i.e. counterclockwise when viewed from above the toy vehicle 212) direction.

It is understood by those skilled in the art that the "neutral" position of the trim mechanism 240 may be modified or changed by change of the lateral position of the trim adjustment member 230 on the chassis 215. The trim adjustment member 230 preferably is slide mounted but might be pivotally mounted to the chassis 215. Lateral movements of the trim adjustment member 230 should be restricted in same conventional way such as the provision of releasably engaging structures (protrusions and recesses) on the facing surfaces of chassis 215 and trim adjustment member 230, or a frictional releasing engagement between the trim adjustment member 230 and chassis 215. The engagement should be sufficiently strong so that the trim adjustment member 230 is not moved by the beams 260 when either beam 260 is biased away from the other arm by movement of the steering link 222 through movement of the crank 246, yet not so strong to prevent the member from being manually moved by the user. A lug portion 298 (shown in phantom) can be extended from beneath the trim adjustment member 230 and through the chassis 215 beneath the trim adjustment member 230 in the figures, to be exposed beneath the chassis 215 for manual manipulation by a user. Those skilled in the art understand that repositioning the trim adjustment member 230 on the chassis 215 allows for the modification of the "neutral" position of the trim mechanism 240.

In operation, an appropriate current is passed through the coil halves 214*a*, 214*b*, and complimentary attractive and repulsive forces are generated between each coil half 214*a*, 214*b* and the magnetic body 224. As a result, the magnetic body 224 is pivoted on the chassis 215 with each end moving towards the coil half 214*a*, 214*b* that exhibits the attractive characteristics and away from the coil half 214*a*, 214*b* that exhibits the repulsive characteristics. In turn, the crank 246 is pivoted about ninety degrees and a distal end portion 246*b* of the crank 246 pushes the steering link 222 in a sideways direction across the chassis 215. This movement of the steering link 222 causes one of the two beams 260 to pivot away from the neutral or central position (FIG. 4). The other beam 260 remains in the neutral or central position held by projection 230*a*, such that the trim mechanism 240 is in the form of a "V" when viewed from above or below. This separation of the beam 260 causes the spring 223 to extend and increases the tension forces within the spring 223. As the steering link 222 is moved across the chassis 215, the turning members 221*a*, 221*b* are pivoted on the chassis 215 and, in turn, the right and left steerable road wheels 211*a*, 211*b* are rotated in either the clockwise (when viewed from above the toy vehicle 212) or counterclockwise (when viewed from above the toy vehicle 212) direction.

When the current flow is stopped to the coil halves 214*a*, 214*b*, there are no longer attractive/repulsive forces between the coil halves 214*a*, 214*b* and the magnetic body 224. The tension in the extend spring 223 causes the beam 260 that was pivoted away from projection 230*a* to pivot back in the opposite direction such that both beams 260 return to the neutral or central position. This movement of the extended and/or pivoted beam 260 pushes the steering link 222 back towards the neutral position. Thus, the turning members 221*a*, 221*b* and the right and left steerable wheels 211*a*, 211*b* are repositioned in the generally straight or neutral direction (FIG. 4).

Figure 5:
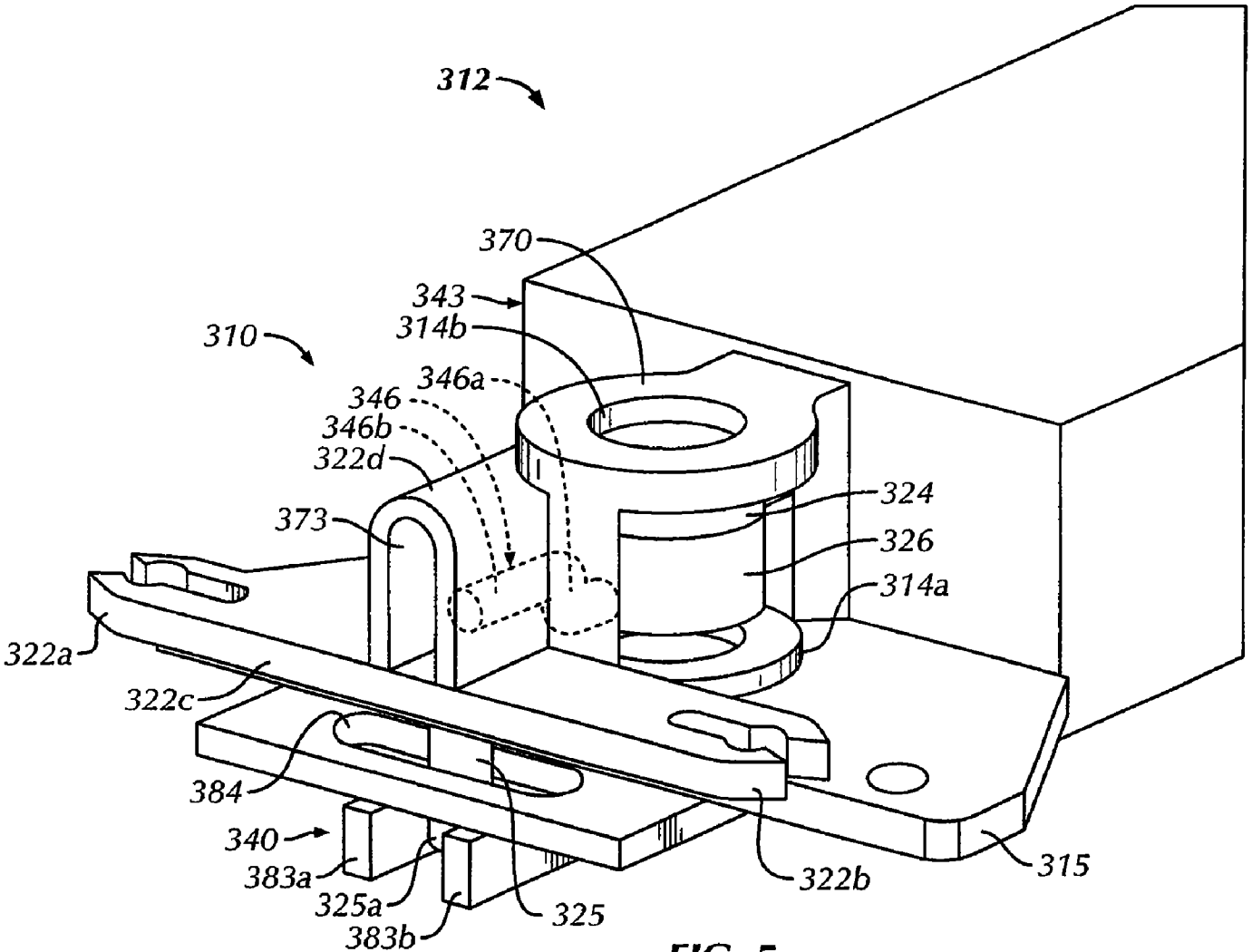
FIG. 5 is a perspective view of the top, front and left side of an adjustable trim mechanism of a steering arrangement of a toy vehicle in accordance with a third preferred embodiment of the present invention, with a body cover of the vehicle, a front cover of the chassis, right and left steering wheels and right and left turning members removed for clarity.
Figure 6:
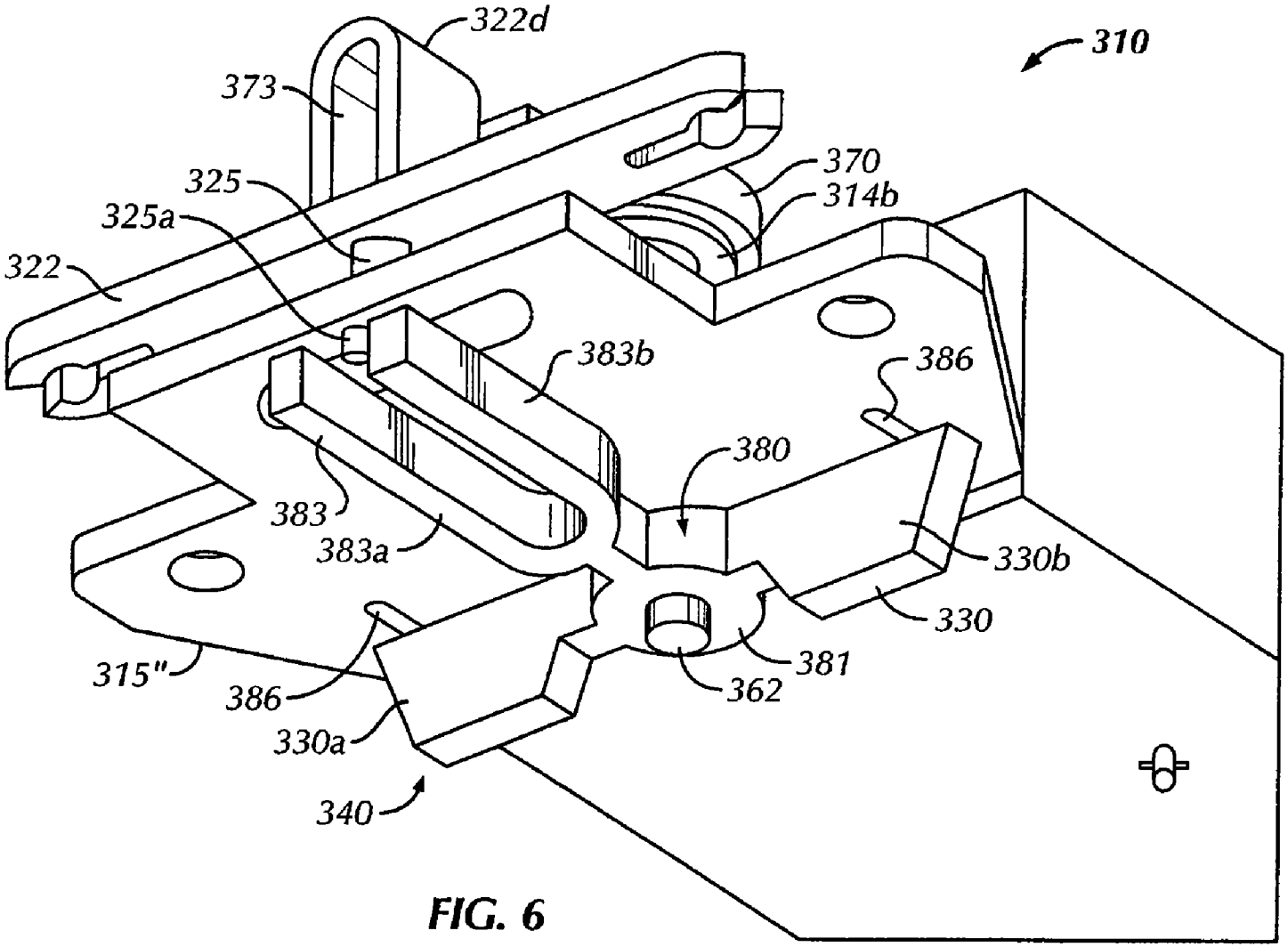
FIG. 6 is a perspective view of the front, bottom and left side of the toy vehicle chassis shown in FIG. 5, with the body cover of the vehicle, the front cover of the chassis, right and left steering wheels and right and left turning members removed for clarity.
Figure 7:
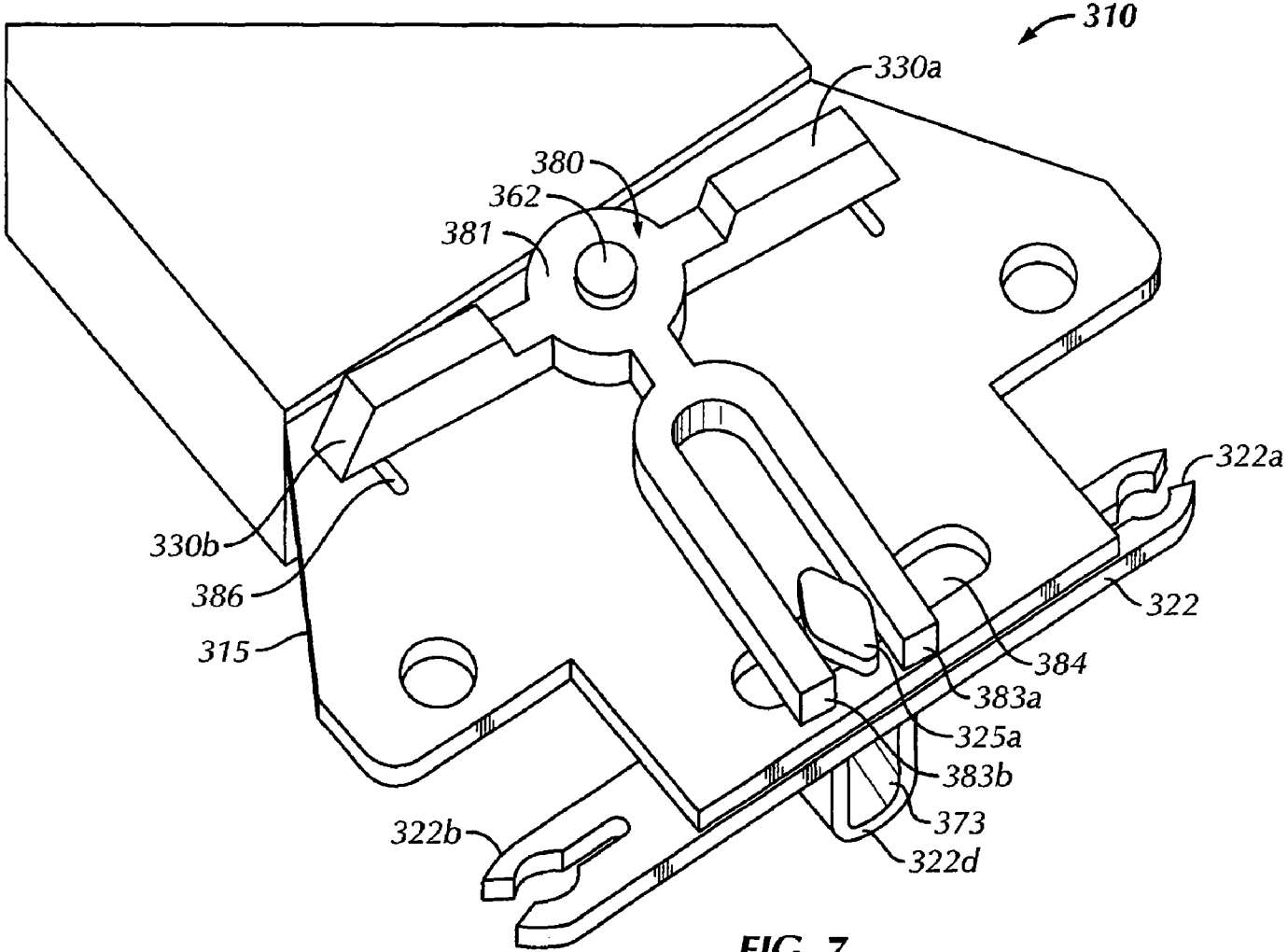
FIG. 7 is a perspective view of the bottom, front and left side of the toy vehicle chassis shown in FIG. 5, with the body cover of the vehicle, the front cover of the chassis, right and left steering wheels and right and left turning members removed for clarity.

Referring to FIGS. 5-7, a third preferred embodiment of an adjustable trim mechanism 340 of a steering arrangement 310 for a toy vehicle 312 is shown, including like reference numerals to indicate like elements. The third preferred embodiment of the toy vehicle 312 and steering arrangement 310 is substantially similar in structure and operation to the first and second preferred embodiments described above. It is understood by those skilled in the art that the toy vehicle 312 and steering arrangement 310 are not limited to the inclusion of the elements shown, but may include additional or fewer elements without departing from the spirit and scope of the present invention.

The adjustable trim mechanism 340 of the third preferred embodiment is located beneath the chassis 315 of the toy vehicle 312 to stabilize the steering arrangement 310 and to help maintain the steering link 322 in the neutral or central position on the chassis 315 when the user is not turning the toy vehicle 312. As seen in FIGS. 6 and 7, the trim mechanism 340 includes a control member 380 with a central hub 381 rotatably engaging a pin 362 that orthogonally extends from beneath the chassis 315. The pin 362 is located at a predetermined distance behind a shaft 325 (described in detail below)

the extends beneath the chassis 315. The trim mechanism 340 further includes a trim adjustment member 330 in the form of two opposing tabs 330*a*, 330*b* that extend from opposite sides of the central hub 381 towards the left and right sides of the chassis 315. A yoke 383, with spaced-apart beams 383*a*, 383*b*, is fixedly connected with the hub 381 to rotate with the hub 381 and opposing tabs 330. The beams 383*a*, 383*b* are preferably in the form of two spring arms or bias members, also extending away from the central hub 381 towards the front of the chassis 315 to partially surround a distal end or cam end 325*a* of shaft 325.

One difference between the steering arrangement 310 of the third preferred embodiment and that of the previously described embodiments is the specific structure of the steering link 322 and its location with respect to the other elements of the steering arrangement 310. The central portion 322*c* of the steering link 322, which is similar to that shown in FIG. 1 and described above, includes an arch 322*d* defining an elongated slot or passageway 373 therethrough. The central portion 322*c* also includes the shaft 325 that extends downwardly through an elongated opening 384 in the chassis 315 and terminates at the cam end 325*a*. When viewed from above or below, the steering link 322 is generally elongated in shape. When viewed from either lateral side, the arch 322*d* extends generally orthogonally from a top surface of the steering link 322 and the shaft 325 extends generally orthogonally from a bottom surface of the steering link 322. Further, in contrast to the above described preferred embodiments, the steering link 322 is located in front of the magnetic body 324, the magnet housing 326 and the coil halves 314*a*, 314*b* of the actuator 343 on the chassis 315 of the toy vehicle 312.

Additionally, the first and second coil halves 314*a*, 314*b* are positioned in a spaced-apart vertical arrangement, such that the coil halves 314*a*, 314*b* are respectively located above and below the magnetic body 324 when the toy vehicle 312 is positioned in a driving configuration with its road wheels on a support surface (not shown). "Driving configuration" is defined herein as any position of the toy vehicle 312 in which the toy vehicle 312 can propel itself forward in response to a user activation on a remote controller. An outer housing 370 partially encloses the magnetic body 324 and magnet housing 326 and fixedly suspends the second coil half 314*b* above the magnetic body 324. The first coil half 314*a* is preferably fixedly attached to a top surface of the chassis 315 and is located directly below the magnet housing 326. Similar to the third preferred embodiment described above, the magnetic body 324 may either extend through an opening (not shown) in the width of the magnet housing 326 such that a portion of each side of the magnetic body 324 is exposed to one of the coil halves 314*a*, 314*b* or the magnetic body 324 may be composed of two separate magnetic bodies (not shown), one on each side face of the magnet housing 326.

Protrusions (not shown), such as knobs or the like, are preferably provided on inner/upper sides of the tabs 330*a*, 330*b* of the trim adjustment member 330 that face the chassis 315. These protrusions are configured to releasably engage a series of appropriately configured recesses 386 located in the facing surface of the chassis 315 such that the angular orientation of the neutral position of the trim mechanism 340 and the lateral location of the neutral position of the steering link 322 can be manually adjusted by rotating the trim mechanism 340 on hub 381 using tabs 330*a*, 330*b*. Of course, the location of the recesses 386 and protrusions of the tabs 330*a*, 330*b* and chassis 315 can be reversed.

In operation, when an appropriate current is passed through either or both of the coil halves 314*a*, 314*b*, attractive and repulsive forces are generated between coil halves 314*a*, 314*b* and the magnetic body 324. As a result, the magnetic body 324 is pivoted on the chassis 315 with its distal ends moving towards the coil half 314*a*, 314*b* that exhibits the attractive characteristic and away from the coil half 314*a*, 314*b* that exhibits the repulsive characteristic. Consequently, a crank 346 (shown in phantom in FIG. 5), which is connected by a crank arm 346*a* to the magnetic body 324, is pivoted such that a distal end portion 346*b* of the crank 346 pushes on an interior surface of the arch 322*d* to force the steering link 322 in a sideways direction across the chassis 315. This movement of the steering link 322 causes the cam end 325*a* of shaft 325 to bear against one of the two bias members 383*a*, 383*b* and to cam that bias member 383*a*, 383*b* away from the depicted neutral or central position and towards the direction in which the steering link 322 is pushed. This movement of the steering link 322 applies a sheer force to one of the bias members 383*a*, 383*b* which generates a reactive force against the shaft 325. The movement of the steering link 322 across the chassis 315 causes the turning members (not shown) operatively connected to the ends 322*a*, 322*b* to pivot on the chassis 315. In turn, the right and left steerable road wheels (not shown) are rotated in either the clockwise or counterclockwise direction to effectuate a change in direction of the toy vehicle 312.

When the flow of current is cut to the coil halves 314*a*, 314*b*, there is no longer an attractive and/or repulsive force between the coil halves 314*a*, 314*b* and the magnetic body 324. Since these attractive and/or repulsive forces no longer exist, the inherent resilience in the spring beams 383*a*, 383*b* causes the one cammed beam to return to the neutral or central position. This movement of the spring beam pushes the steering link 322 back towards the neutral position. Thus, the turning members and the right and left steerable wheels are repositioned in the generally straight or neutral direction.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claim(s).

We claim:

1. In a toy vehicle including a chassis having opposing right and left sides and opposing front and rear ends, a right steerable road wheel on said right side of said chassis, a left steerable road wheel on said left side of said chassis, a right turning member supporting said right steerable road wheel and a left turning member supporting said left steerable road wheel, each of said right and left turning members being pivotally mounted to said chassis to pivotally support a separate one of said steerable road wheels from said chassis, a rigid steering link extending across said chassis in a width direction, said steering link having a right end, a left end and a central portion therebetween, said right and left ends of said steering link being operatively connected with said right and left turning members, respectively, an actuator mounted onto said chassis and moving said steering link linearly side to side on said vehicle, wherein said right and left road wheels are pivoted by the motion of said steering link, the improvement comprising:

an adjustable trim mechanism mounted to said chassis, said adjustable trim mechanism comprising:

a trim adjustment member repositionably mounted on said chassis so as to be accessible for manual access on an underside of said chassis, wherein repositioning said trim adjustment modifies a position on said chassis at which said steering link and road wheels are maintained in said neutral position; and two spaced-apart beams extending between said trim adjustment member and said steering link generally orthogonally with respect to said steering link, a first end of said two beams extending into contact with part of said steering link and a second end of said beams coupled with said trim adjustment member so as to be pivoted by said trim adjustment member around a pin extending vertically from said chassis; a bias member extending generally orthogonally with respect to said two beams coupling together said two beams at a location between said first and second ends.

2. The toy vehicle of claim 1, wherein said trim adjustment member further comprises a downwardly extending lug positioned and configured for manual movement of said trim adjustment member and wherein said bias member maintains said beams clamped against part of said trim adjustment member opposite said lug.

3. The toy vehicle of claim 2, wherein said steering link is positioned between said trim adjustment member and said actuator on said chassis.

4. The toy vehicle of claim 1, wherein said adjustable trim mechanism is positioned beneath said chassis when said toy vehicle is in said driving configuration.

5. The toy vehicle of claim 4, wherein said trim adjustment member of said adjustable trim mechanism further comprises two opposing tabs that extend from opposite sides of a central hub towards said left and right sides of said chassis.

6. The toy vehicle of claim 5, wherein said two beams are integrally formed in one piece with said central hub and extend from said central hub to said steering link.

7. The steering arrangement of claim 1, wherein said central portion of said steering link includes an arch defining a passageway therethrough and said arch and said passageway generally orthogonally extend from said steering link.

8. The toy vehicle of claim 7, said central portion of said steering link further including a shaft extending from a bottom surface thereof, a distal end of said shaft terminates at a cam.

9. The toy vehicle of claim 8, wherein said two beams surround at least a portion of said cam.

10. The toy vehicle of claim 1, said actuator further comprising:

a magnetic body mounted onto said chassis to pivot on an axis extending longitudinally forward and rearward in said vehicle; wherein said magnet body includes two opposite magnetic poles at opposing distal ends of the magnetic body on opposite sides of said axis; and a crank on said axis connected with said magnetic body to pivot with said magnetic body and operatively connected with said central portion to move said connecting member side to side on said vehicle.

11. The toy vehicle of claim 9, said actuator further comprising:

a first coil half and a second coil half, said first and second coil halves being positionable in a spaced-apart manner onto said chassis.

12. The toy vehicle of claim 1, wherein said trim adjustment member is mounted to slide across said chassis.

13. The toy vehicle of claim 1, wherein said trim adjustment member is pivotally mounted to a portion of said chassis.

* * * * *